US005706962A

United States Patent [19]

Tauber

[11] Patent Number: 5,706,962

[45] Date of Patent: Jan. 13, 1998

[54] THUMB TAB CHILD RESISTANT CLOSURE

[75] Inventor: John Tauber, Harford County, Md.

[73] Assignee: Poly-Seal Corporation, Baltimore, Md.

[21] Appl. No.: 590,027

[22] Filed: Feb. 2, 1996

[51] Int. Cl.[6] ..... B65D 55/02

[52] U.S. Cl. ..... 215/218; 215/206

[58] Field of Search ..... 215/201, 206, 215/217, 218, 219, 221

[56] References Cited

U.S. PATENT DOCUMENTS

| | | | |
|---|---|---|---|
| D. 226,054 | 1/1973 | Nixdorff, Jr. . | |
| 1,198,948 | 9/1916 | Newton . | |
| 1,999,622 | 4/1935 | Algeo . | |
| 2,153,426 | 4/1939 | McNamara et al. . | |
| 2,162,880 | 6/1939 | Brown . | |
| 2,980,275 | 4/1961 | Lundgren . | |
| 3,027,034 | 3/1962 | Christian . | |
| 3,163,277 | 12/1964 | Reading . | |
| 3,233,769 | 2/1966 | Jessop . | |
| 3,308,979 | 3/1967 | Hailes . | |
| 3,403,803 | 10/1968 | Markowitz . | |
| 3,486,654 | 12/1969 | Schellhas . | |
| 3,601,274 | 8/1971 | Johnson . | |
| 3,729,110 | 4/1973 | Taylor . | |
| 3,750,817 | 8/1973 | Bozek . | |
| 3,811,589 | 5/1974 | Thornton et al. . | |
| 3,830,392 | 8/1974 | Kessler et al. . | |
| 3,850,325 | 11/1974 | MacLeod . | |
| 3,858,740 | 1/1975 | Lestaevel . | |
| 3,892,325 | 7/1975 | Maguire . | |
| 3,901,400 | 8/1975 | Westfall . | |
| 3,905,509 | 9/1975 | Markowitz . | |
| 4,002,258 | 1/1977 | Curry . | |
| 4,006,836 | 2/1977 | Micallef . | |
| 4,061,239 | 12/1977 | Tasseron | 215/221 |
| 4,103,797 | 8/1978 | Morris | 215/217 X |
| 4,337,869 | 7/1982 | Guinle . | |
| 4,399,921 | 8/1983 | Kusz . | |
| 4,512,484 | 4/1985 | Mar . | |
| 4,519,514 | 5/1985 | Agbay et al. | 215/225 |
| 4,619,370 | 10/1986 | Agbay et al. | 215/225 |
| 4,690,292 | 9/1987 | Henning . | |
| 4,865,209 | 9/1989 | Bush . | |
| 4,874,102 | 10/1989 | Jessop et al. . | |
| 5,027,954 | 7/1991 | Hickerson . | |
| 5,058,754 | 10/1991 | Hickerson . | |
| 5,224,615 | 7/1993 | Hickerson . | |
| 5,246,123 | 9/1993 | Kramer et al. . | |
| 5,310,074 | 5/1994 | Jochem et al. . | |

*Primary Examiner*—Stephen Cronin

*Attorney, Agent, or Firm*—Dickstein Shapiro Morin & Oshinsky LLP

[57] ABSTRACT

A child resistant safety closure including a body portion defining a chamber, a hollow neck extending from said body portion and having an outside surface, and a container screw thread formed on said outside surface of said neck and extending circumferentially around an axis. A ring encircles said neck of said container and has an outer ring surface and an inner ring surface. A cap having an inner cap surface and a cap screw thread formed on said cap inner surface engages said container screw thread when said cap is twisted onto said container. A pair of interface surfaces located between said inner ring surface and said outside surface of said neck, and between said inner cap surface and said outer ring surface supports a safety mechanism that includes a lug and a recess, which slides over said lug, and two sets of ratchets, which engage each other more closely as said recess slides over said lug, but which slide over each other when said recess is prohibited from rotating.

27 Claims, 6 Drawing Sheets

THUMB TAB CHILD RESISTANT CLOSURE

BACKGROUND

The present invention relates to closures for bottles, and more specifically, to child resistant safety closures.

Safety closures that prevent children from opening containers are useful for medicine bottles, cleaning supplies containers, or bottles containing other dangerous substances. To be effective, safety closures must be too difficult for children to operate yet easy for adults to manipulate. In addition, safety cap designs must recognize the limitations of the manufacturing process and therefore, the closure should be simple and have few parts in order to be manufactured and assembled easily and economically.

Many safety closure have two caps, one of which fits over the other. The outer cap must be pushed down firmly in order to engage and turn the inner cap. Another type of closure requires the user to line up a section of the cap with a section of the container and then push the cap upwardly to pop it off. A third type of child resistant closure uses a single cap and a ring or lug that is manipulated in some way.

Many of the problems with child resistant safety closures are related to the manipulation required for disengaging the safety mechanism. For example, having to deform the container or cap to disengage the safety mechanism requires the adult to apply a significant force to either the container or the cap, which is difficult for the elderly, the infirm, and arthritis sufferers. A similar use of force is needed for those safety caps which require the operator to push downward on the cap and turn to open the container.

A second problem with the child safety closures of the prior art is high manufacture costs which are incurred because the designs are too complicated and use too much material. Moreover, assembly of many closures is cumbersome because of the complexity of the designs and the number of parts. For example, one design uses a ring whose center is off-set from the center of the cap. Closures using these eccentric rings are difficult to manufacture.

Therefore, there is a need in the art for a child resistant safety closure that can be opened without having to apply a noticeable force, but in which the method of disengaging the safety mechanism is not obvious, and that can be manufactured and assembled both economically and easily.

SUMMARY

The present invention alleviates the disadvantages of the prior art by providing a child resistant safety closure including a body portion defining a chamber, a hollow neck extending from the body portion and having an outside surface, and a container screw thread formed on the outside surface of the neck and extending circumferentially around an axis. A ring encircles the neck of the container and has an outer ring surface and an inner ring surface. A cap having an inner cap surface and a cap screw thread formed on the cap inner surface engages the container screw thread when the cap is twisted onto the container. Two pairs of interface surfaces located between the inner ring surface and the outside surface of the neck, and between the inner cap surface and the outer ring surface support a safety mechanism that includes a lug and a recess, which slides over the lug, and two sets of ratchets, which engage each other more closely as the recess slides over the lug, but which slide over each other when the recess is prohibited from rotating. In essence, the movement of a lug within a recess which causes ratchets, or other engagement portions, to engage in order to prevent the removal of a cap is the subject of the present invention.

It is an objective of the present invention to provide a child resistant safety closure that can be opened easily by an adult once he is given proper instruction.

It is a further objective of the present invention to provide a child resistant closure that does not require the user to provide substantially more force to open than a non-child proof closure requires.

It is another objective of this invention to provide a child resistant closure that is difficult for children to open because disengagement of the safety mechanism is not obvious.

It is yet an additional objective of the present invention to provide a child resistant closure that is easy to close.

It is a further objective of the present invention to provide a child resistant safety closure that is simpler to manufacture than those in the prior art.

It is a final objective of the present invention to provide a child resistant closure that uses less material and requires fewer steps in manufacture and assembly.

These and other objects, features and advantages of the present invention will become apparent from the following detailed description, drawings, abstract and claims of the preferred embodiments of the present invention.

DETAILED DESCRIPTION OF A PREFERRED EMBODIMENT

Figure 1:
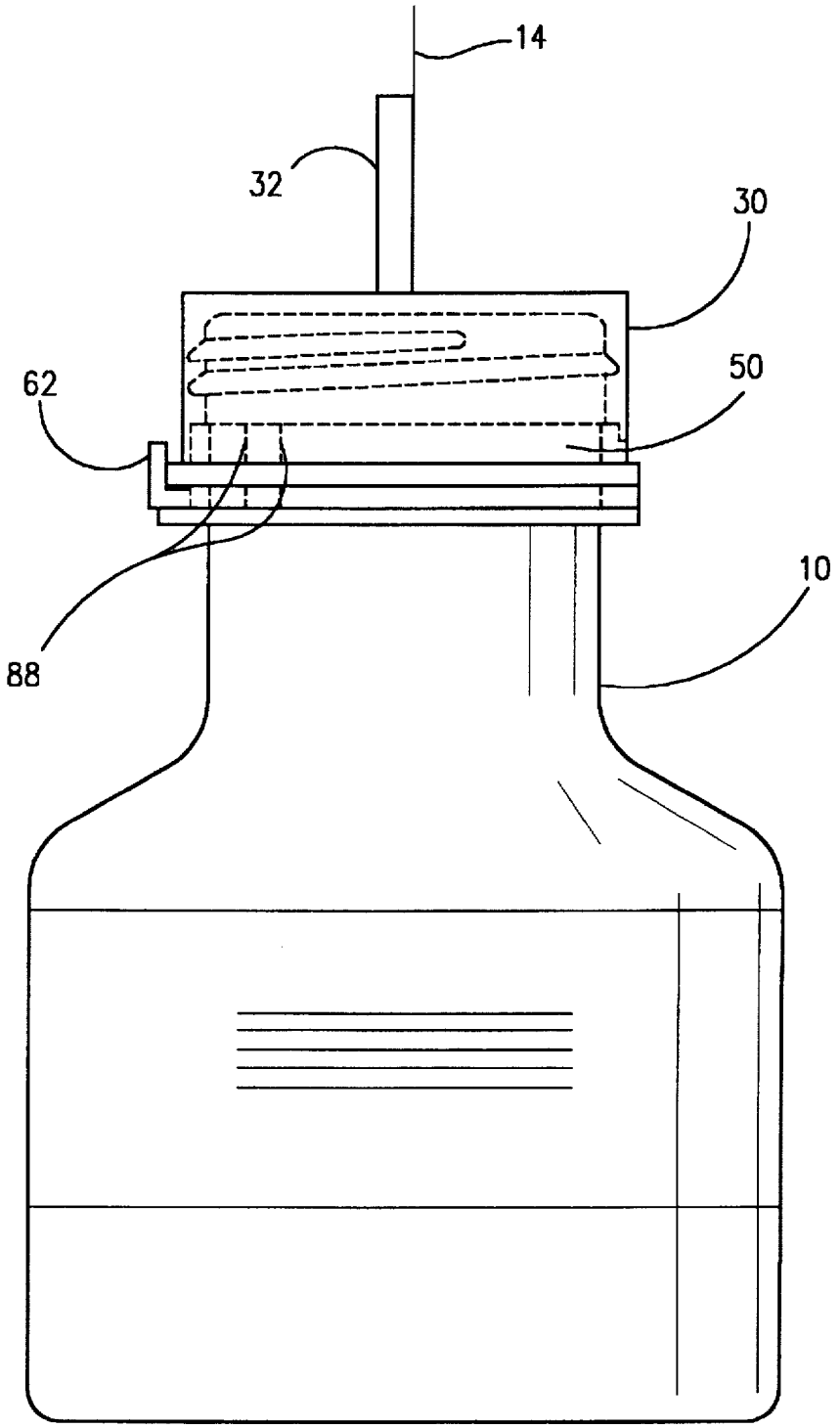
FIG. 1 is a side view of a preferred embodiment of the child resistant closure showing the cap, ring and container assembled.
Figure 2:
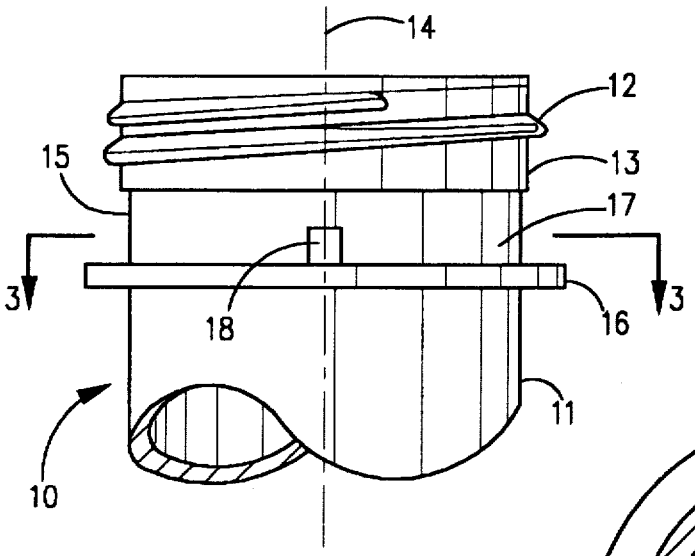
FIG. 2 is a side view of the container of FIG. 1.
Figure 3:
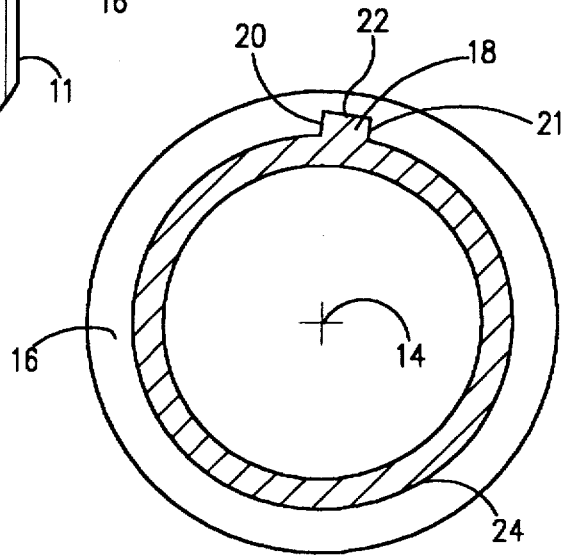
FIG. 3 is a view taken along line section 3—3 of FIG. 2.

Refer now to FIGS. 1–3, there being shown a child resistant closure according to a preferred embodiment of the present invention. When the closure is assembled, the ring 50, or another intermediate portion, fits between the container 10 and the cap 30 and all of these elements have concentric axes 14. The cap 30 has a handle 32 used to turn the cap 30. The ring has a ring tab 62 used to hold the ring 50 stationary while turning the cap 30. As described in greater detail below, if a child attempts to open the closure by merely turning the cap 30, the ring 50 rotates with the cap 30 approximately thirty degrees and then both the ring 50 and the cap 30 do not rotate further because engagement portions on the ring 50 and the cap 30 engage. If, however, one holds the ring 50 stationary while turning the cap 30, the engagement portions do not engage each other and the cap 30 screws off of the container 10 easily.

FIGS. 2 and 3 show a preferred embodiment of the child resistant closure's container 10 according to the present invention. A container 10 has a body portion 11 and a cylindrical neck portion 13 extending from the body portion 11. A container screw thread 12 is formed to extend around the outside surface 24 of the neck portion 13 about an axis 14. Positioned below the container screw thread 12, a flange 16 protrudes outwardly and extends around the container 10, separating the body portion 11 from the neck portion 13. The ring 50 rests on this flange 16 when the closure is assembled. Positioned between the flange 16 and the screw thread 12, a holding recess 17 is formed into the neck portion 13 such that the outer diameter of the neck portion 13 at the holding recess 17 is smaller than the outer diameter of the neck portion 13 generally. The ring 50 sits in this holding recess 17 when the closure is assembled.

A lug 18 extends from the flange 16 and has two lug side surfaces 20, 21 and a lug outside surface 22. The lug side surfaces 20, 21 extend between the container neck outside surface 24 and the lug outside surface 22. The lug outside surface 22 is formed generally parallel to the container neck outside surface 24. The ring 50 is rotated over the lug 18 in order to cause the engagement portions to engage and therefore, prevent the closure from opening.

Figure 4:
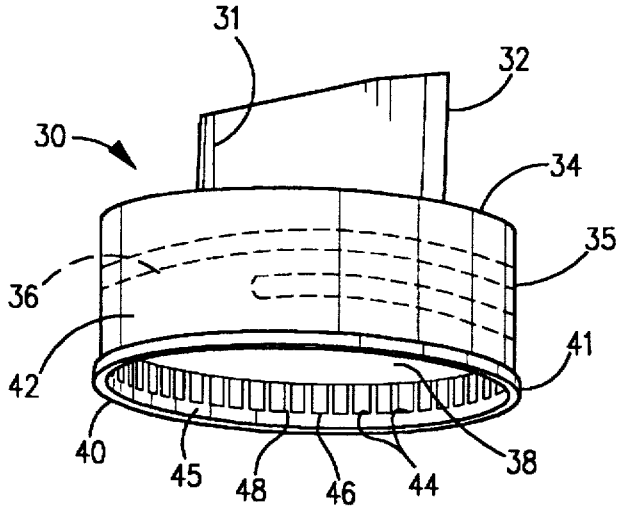
FIG. 4 is a perspective bottom view of the cap of FIG. 1.

Refer now to FIG. 4 showing a preferred embodiment of the child resistant closure's cap 30. The cap 30 is generally cylindrical having a substantially flat top 34, cylindrical sides 35, and an open bottom 40. The cap 30 has a long flat handle 32 extending from and integrally molded with the top 34. This handle 32 helps the user turn the cap 30 in order to open and close the container 10. Vertical ribs 31 are formed on the handle 32 in order to improve its grip. A cap screw thread 36 is formed to extend around the inner surface 38 of the cap sides 35 about an axis 14 that is concentric with the axis 14 of the container. This cap screw thread 36 mates with the container screw thread 12. The outer surface of the cap sides 35 can be ribbed in order to help the user grip the cap during operation. At the bottom of the cap 40, a cap lip 41 extends around the outside surface of the cap 42 and has an outer diameter larger than the outer diameter of the cap sides 35. This cap lip 41 facilitates the manufacturing of the cap 30.

Also at the cap bottom 40, but on the cap inner surface 38, a set of cap ratchets 44 is formed in a recess 45 formed into the cap inner surface 38. These cap ratchets 44 protrude from the recess 45 but do not extend radially as far as the diameter of the cap inner surface 38. This configuration enables the cap 30 to be molded more easily. The cap ratchets 44 encircle the cap 30 for 360 degrees. The individual cap ratchets 44 in cross-section are arcuate, shaped like portions of semi-circles 46, see FIG. 9, that are convex with respect to the recess 45. The cap ratchets 44 can also have other shapes, such as like teeth, or like the ring ratchets 54 discussed below. The semi-circles portions 46 are spaced equally along the cap inner surface 38 such that there are spaces 48, see FIG. 9, between the semi-circles 46. The spaces 48 receive corresponding ring ratchets 54 described below. These ratchets 44 serve as the engagement portion on the ring 50.

Figure 5:
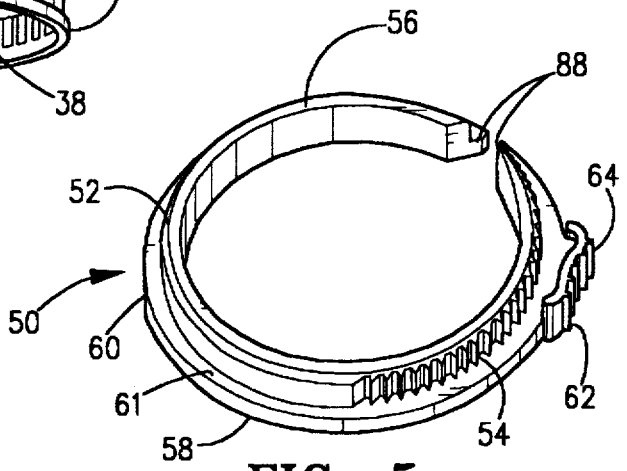
FIG. 5 is a perspective top view of a ring of the closure of FIG. 1.
Figure 6:
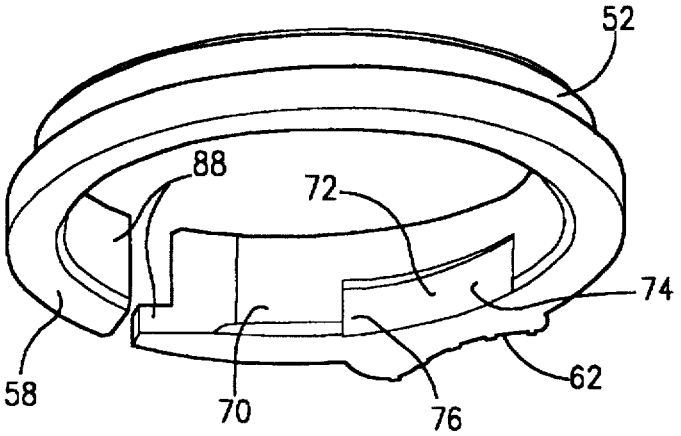
FIG. 6 is a perspective bottom view of the ring of FIG. 5.
Figure 7:
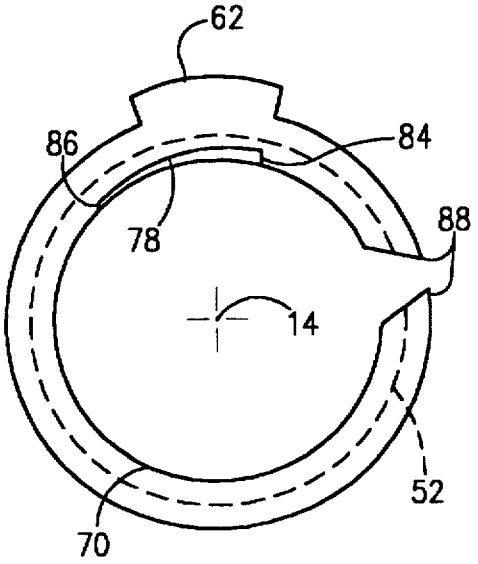
FIG. 7 is a bottom view of the ring of FIG. 5.

Refer now to FIGS. 5–7 showing a preferred embodiment of the ring 50 according to the present invention. The ring 50 is circular about an axis 14, and thus is concentric with the neck portion 13 of the container and the cap. The ring 50 has two ends 88, which help the safety mechanism to engage by allowing the ring 50 to expand as it is rotated over the lug 18. These ends 88 are formed at angles that slant away from each other; one angle is larger than the other. However, the ring 50 does not necessarily need to be discontinuous. Using a material that deforms easily would enable the ring to be continuous. Nevertheless, the ring 50 should be made of a material that can be deformed, such as polypropylene, by the lug 18. One of the advantages of polypropylene is that its manufacturing requires fewer steps than other polycarbonates, such as polystyrene, which must be pre-loaded.

A set of ring ratchets 54 is formed into the ring outer surface 52 and extends radially no further than the ring outer surface 52. These ring ratchets 54 extend circumferentially around the ring 50 for approximately 125 degrees and from the ring top 56 to the ring lip top 61. The individual ring ratchets 54 have straight radial sides 53, see FIG. 9, that are perpendicular to the ring outer surface 52, and slanted sides 55, see FIG. 9, that make acute angles with both the radial sides 53 and the ring outer surface 52. These ring ratchets 54 serve as the engagement portion on the ring 50. The ring ratchets 54 engage the set of cap ratchets 44 when the cap is turned counter clockwise because they fit inside the spaces 48 between the semi-circle shaped ratchets 46, and because the cap ratchets 44 catch the radial sides 53 of the ring ratchets 54. This shape enables the ring ratchets 54 to engage the cap ratchets 44 effectively. However, other shapes are possible. Furthermore, when both the ring ratchets 54 and the cap ratchets 44 are shaped to have radial and angled sides, as described above, engagement is improved.

When the cap 30 is turned clockwise, the cap ratchets 44 do not engage the ring ratchets 54 because the cap ratchets 44 slide over the slanted sides 55 of the ring ratchets 54. This motion permits the cap 30 to rotate while the ring 50 remains still.

A ring lip 60 extends from the ring outer surface 52 at the ring bottom 58. This lip has the same outer diameter as the cap lip 41. From the ring lip 60, a ring tab 62 extends proximate to the ring ratchets 54. Users of the invention hold this ring tab 62 stationary in order to restrict the movement of the ring 50. The ring tab 62 curves parallel with the ring 50 and has vertical ribs 64 in order to make it easier for the user to hold the ring tab 62 with a finger or thumb. However, the configuration of the ring tab 62 can vary. Furthermore, the ring 50 does not necessarily need to have a ring tab 62. For example, a user could restrict the movement of a ring not having a ring tab with a fingernail, finger, or thumb.

A recess 72 is formed into the inner surface 70 of the ring 50 which receives the lug 18 when the closure is assembled. This recess 72 has a shallow end 74, a deep end 76, and a wall 78 that extends between these ends 74, 76. The deep end 76 and the wall 78 form a shoulder 84 that engages the lug outside surface 22 and one of the lug side surfaces 20 when the ring 50 is rotated clockwise. At the shallow end 74, an angled edge 86 lies adjacent to the wall 78. This angled edge 86 allows the ring 50 to slide over the lug 18 when the ring 50 is rotated counter clockwise when the cap 30 is not secured onto the container 10.

Figure 8:
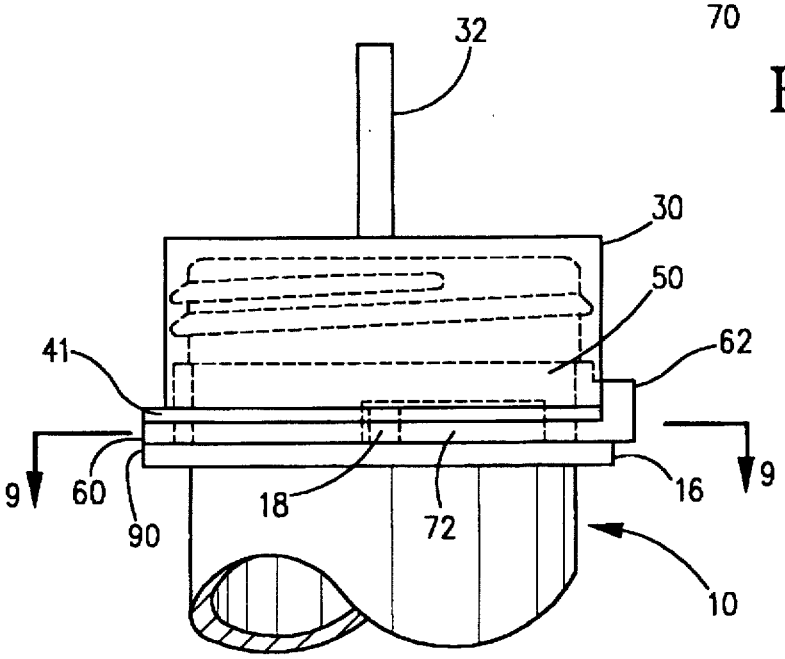
FIG. 8 is a side view of the assembled child resistant closure of FIG. 1, showing the opposite side.

Refer now to FIG. 8, showing the cap 30, ring 50 and container 10 assembled. When the closure is closed, the cap bottom 40 rests adjacent to the ring lip top 61. Furthermore, the cap lip 41 and the ring lip 60 form a generally flush surface 90 with the flange 16 because the outer diameters of these three elements are about the same. The ring tab 62 is located beyond the flush surface 90 and extends upwardly over the cap lip 41. The position of the ring tab 62 facilitates locating and gripping the ring tab 62 when disengaging the safety mechanism.

Figure 9:
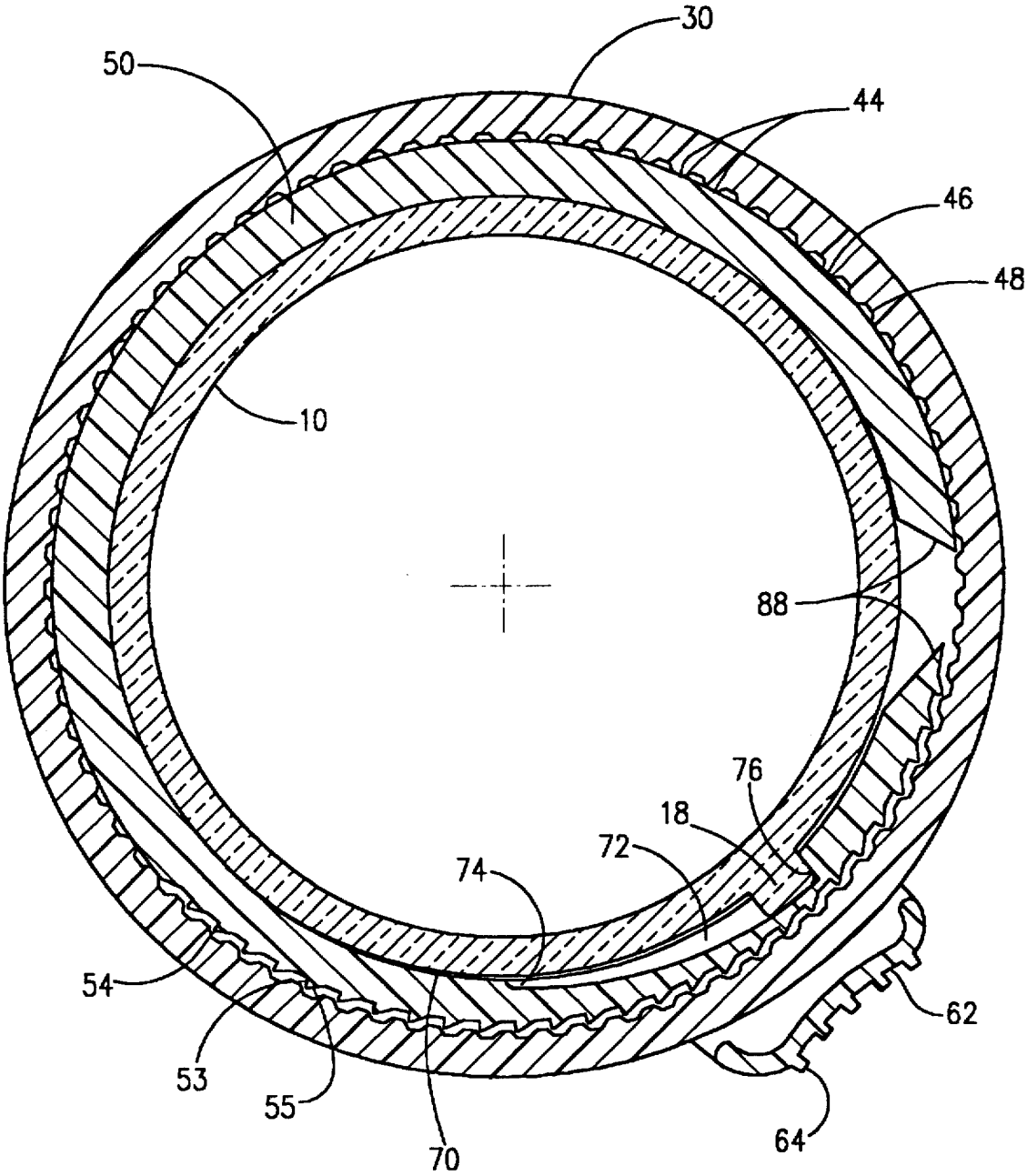
FIG. 9 is a view taken along line section 9—9 of FIG. 8 showing the child resistant closure in the closed position.

Refer now to FIG. 9 showing the ring tab 62, ring 50, cap 30 and container 10 when the closure is closed and the recess is in a first position. The ring 50 is located between the container 10 and the cap 30, thereby creating two pairs of interface surfaces. The first pair of interface surfaces includes the inner surface 70 of the ring 50 and the outside surface 15 of the neck portion 13. The lug 18 is located on one of the interface surfaces, specifically on the outside surface 15 of the neck. The recess 72 is located on the other interface surface, specifically on the ring inner surface 70. This lug 18 and recess 72 are included in a first locking arrangement.

The second pair of interface surfaces includes the outer surface 52 of the ring 50 and the inner surface 38 of the cap 30. Engagement portions, such as ratchets 44, 54, are located on each of the interface surfaces and are included in a second locking arrangement. Specifically, the cap ratchets 44 are located on the cap inner surface 38, and the ring ratchets 54 are located on the ring outer surface 52.

In this first position, the lug 18 is positioned in the deep end 76 of the recess 72 next to the shoulder 84 and the ring ratchets 54 and the cap ratchets 44 do not engage each other.

Figure 10:
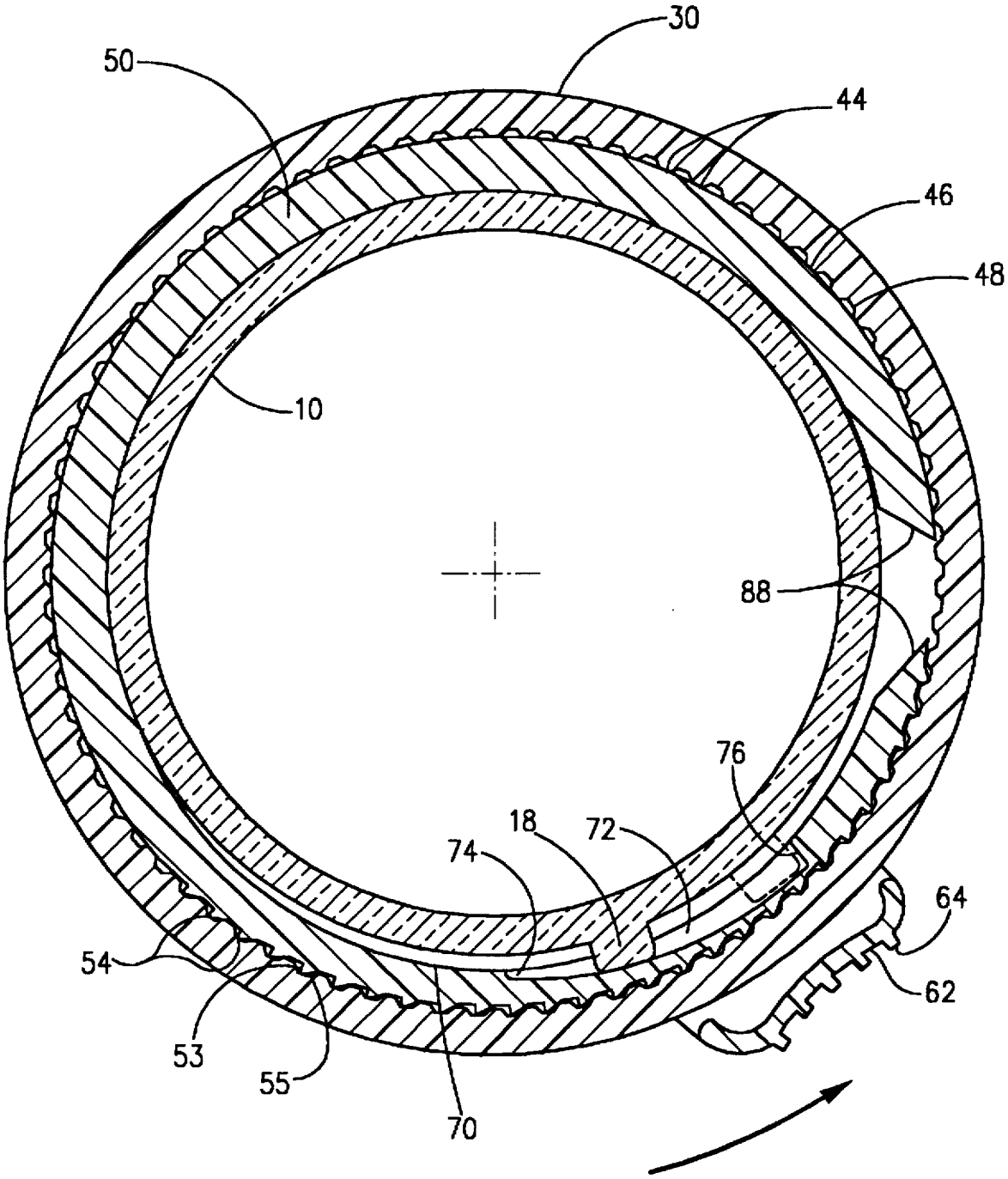
FIG. 10 is a view like FIG. 9 showing the child resistant closure in the position which results from the cap being turned without the ring tab being held stationary.

Contrast FIG. 10 showing the tab 62, ring 50, cap 30 and container 10 when the recess is in a second position which results from an attempt to open the closure without holding the ring tab 62 stationary. The ring 50 has rotated to a position in which the shallow end 74 of the recess 72 is pushed over the lug 18. As a result, the ring 50 is deformed, which causes the ring ratchets 54 to be pushed into the spaces 48 between the semi-circles 46. Thus, the ring ratchets 54 engage the cap ratchets 44 and prohibit the cap 30 from rotating further.

In operation, moving the closure from the position shown in FIG. 9 to the position shown in FIG. 10 engages the safety mechanism. When a user attempts to open the closure but fails to restrict the movement of the ring 50, the ring ratchets 54 engage the cap ratchets 44 lightly which rotates the ring 50 with the cap 30. As the shallow end 74 of the recess 72 approaches the lug 18, however, the ring ratchets 54 engage the cap ratchets 44 more closely. When the shallow end 74 covers the lug 18, the ring ratchets 54 engage the cap ratchets 44 tightly. As a result, the cap 30 cannot turn counter clockwise.

In order to disengage the safety mechanism, a user starts from the closed position, FIG. 9, and restricts the rotation of the ring 50 by holding the ring tab 62 stationary. As a result, the recess 72 is not pushed over the lug 18 and the two sets of ratchets, 44, 54, do not engage each other. Therefore, the cap ratchets 44 slide over the ring ratchets 54 and the cap 30 can rotate counter clockwise.

Figure 11:
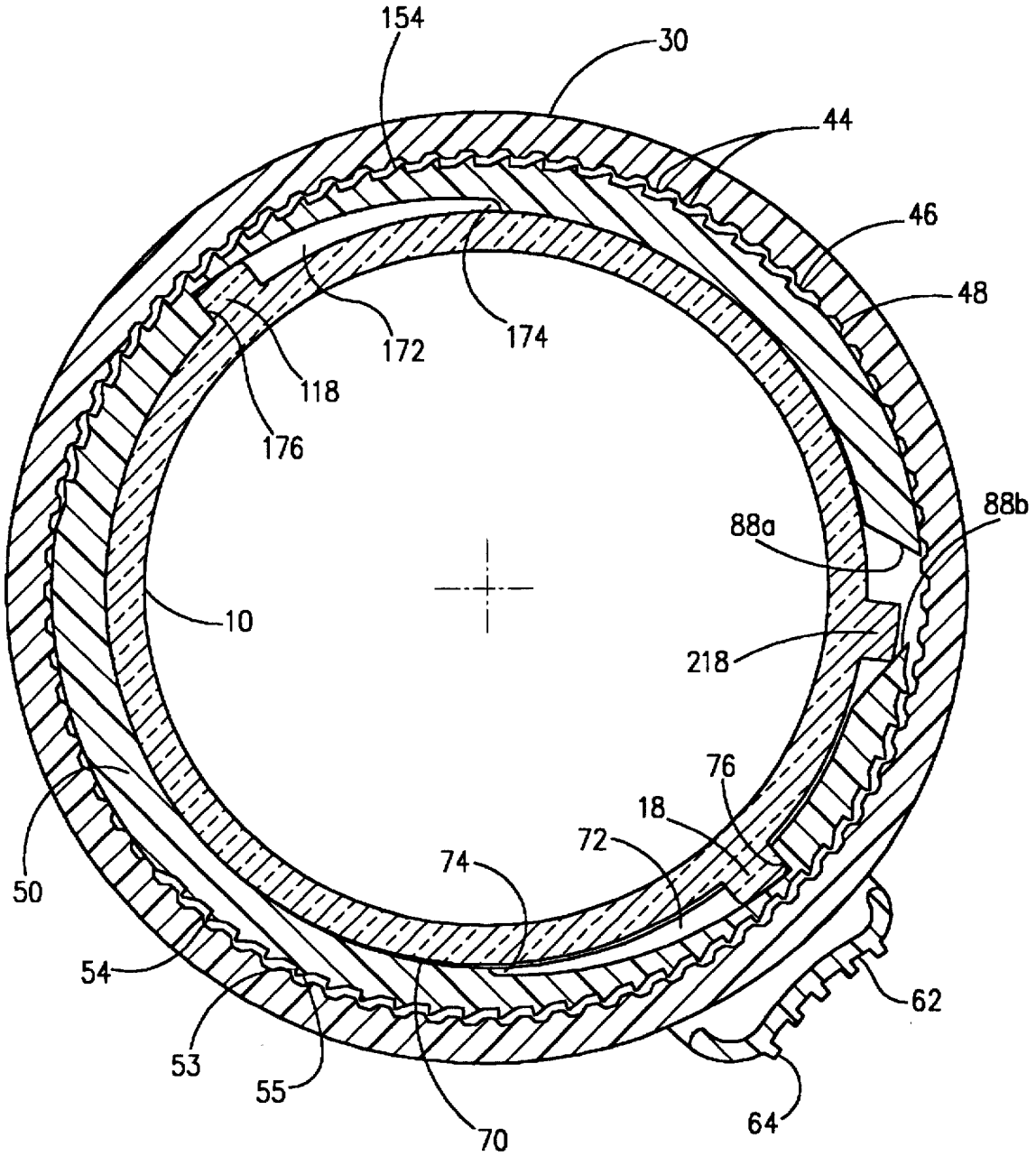
FIG. 11 is a view like FIG. 9 showing another embodiment of the child resistant closure in the closed position.

Refer now to FIG. 11 showing an embodiment having more than one lug and recess. Using more than one lug and recess causes the ratchets to engage more effectively. The closure in FIG. 11 is in the closed position. A second lug 118 and a second recess 172 are located approximately 180 degrees from the first lug 18 and the first recess 72 described above. The second lug 118 is positioned in the deep end 176 of the second recess 172. A second set of ring ratchets 154 are located proximate to the second recess 172 and are positioned to engage the cap ratchets 44. When the ring 50 is rotated, the shallow end 174 of the second recess 172 is pushed over the second lug 118 and the first recess 72 is pushed over the first lug 18, as described above. As a result, the cap ratchets 44 engage both sets of ring ratchets 54, 154 and the cap 30 is more securely prevented from being removed.

Furthermore, FIG. 11 shows a third lug 218 located proximate to one of the angled ends **88*b* of the ring 50. Like the shallow end of the recess 72 described above, the angled end 88*b* is pushed over the lug 218 as the ring rotates 50. As the angled end 88*b* is pushed over the lug 218, the ring 50 is deflected outwardly which causes the engagement portions 54 of the ring 50 to engage the engagement portions 44 of the cap 30. This engagement prevents the removal of the cap 30**.

The child resistant closure can be formed with different combinations of lugs, recesses and angled ends. For example, as shown in FIG. 11, the closure could have a lug which engages an angled end, and two lugs each engaging a recess. The closure could also employ only one lug and an angled end, or only one lug-recess combination, as shown in FIGS. 9 and 10. Moreover, more than two lugs and recesses could be used and the spacing of the lugs and recesses around the circumference of the closure could vary. Other combinations of these elements would also be possible.

The above description and drawings are only illustrative of preferred embodiments of the present invention, and are not intended to limit the present invention thereto. Any modification of the present invention which comes within the spirit and scope of the following claims is to be considered part of the present invention. The above description discloses specific shapes, configurations and locations for the cap ratchets 44, the ring ratchets 54, the lug 18, and the recess 72. However, other shapes, configurations, and locations are possible. In addition, the ring 50 could be replaced by another type of intermediate portion serving the same function. The essence of the invention is that when a lug 18 is kept from pushing engagement portions 44, 54 into engagement with each other, the cap 30 rotates freely and can be removed from the container 10.

What is claimed as new and desired to be protected by Letters Patent of the United States is:

1. A child resistant closure comprising:

a container including a body portion defining a chamber, a hollow neck extending from said body portion and having an outside surface, and a container screw thread formed on said outside surface of said neck;

a ring encircling said neck and having an outer ring surface and an inner ring surface;

a cap having an inner cap surface and including a cap screw thread formed on said cap inner surface and sized to engage said container screw thread when said cap is twisted onto said container;

a first pair and second pair of interface surfaces, said first pair of interface surfaces including said inner ring surface and said outside surface of said neck, and said second pair of interface surfaces including said outer ring surface and said inner cap surface;

a first locking arrangement including a lug and a recess formed on said first pair of said interface surfaces, said lug being located on and protruding from said outside surface of said neck and said recess being formed on said inner ring surface, and wherein said lug is aligned with and extends into said recess;

a second locking arrangement including a first engagement portion and a second engagement portion located on said second pair of interface surfaces, said first engagement portion being located on said outer ring surface and said second engagement portion being located on said inner cap surface;

wherein said recess is moveable with respect to said lug such that said lug moves from a first position to a second position;

wherein said lug sits in a deep end of said recess and said first and second engagement portions lightly touch each other in said first position, and wherein said lug sits in a shallow end of said recess and said first and second engaging portions engage each other in said second position.

2. The closure of claim 1 wherein said container neck, said ring and said cap are concentric about a common axis.

3. The closure of claim 2 wherein said first position is offset less than 360 degrees from said second position about said common axis.

4. The closure of claim 2 wherein said first position is offset approximately 30 degrees from said second position about said common axis.

5. A child resistant closure comprising:

a container including a body portion defining a chamber, a hollow neck extending from said body portion and having an outside surface, and a container screw thread formed on said outside surface of said neck;

an intermediate portion encircling said neck;

a cap having an inner cap surface and including a cap screw thread formed on said cap inner surface and sized to engage said container screw thread when said cap is twisted onto said container;

a first locking arrangement including at least one lug and at least one recess, said recess being formed in said intermediate portion and including a deep end and a shallow end, and said lug being aligned with and extending into said recess;

a second locking arrangement including a first engagement portion and a second engagement portion, said first engagement portion being formed in said intermediate portion opposite said recess;

wherein said recess is moveable with respect to said lug such that said lug moves from a first position to a second position; and wherein said lug extends into said deep end of said recess and said first and second engagement portions lightly touch each other in said first position, and wherein said lug extends into said shallow end of said recess in said second position urging said first and second engaging portions to operably engage each other.

6. The closure of claim 5 wherein said container neck, said intermediate portion and said cap are concentric about a common axes.

7. The closure of claim 6 wherein said first position is offset less than 360 degrees from said second position about said common axis.

8. The closure of claim 6 wherein said first position is offset approximately 30 degrees from said second position about said common axis.

9. The closure of claim 5 wherein said lug is located on said outside surface of said neck, and said recess is located on an inner surface of said intermediate portion.

10. The closure of claim 5 wherein said first engagement portion extend less than 360 degrees around said intermediate portion, and said second engagement portions extend 360 degrees around said inner cap surface.

11. The closure of claim 5 wherein said first and second engagement portions further include ratchets formed on each engagement portion.

12. The closure of claim 11 wherein at least one of said first engagement portion's ratchets have straight radial sides which are perpendicular to an outer surface of said intermediate portion, and slanted sides that make acute angles with both said radial sides and said outer surface of said intermediate portion; and at least one of said second engagement portion's ratchets include semi-circle portions extending from said cap inner surface convexly with respect to said cap inner surface and spaced equally along said cap inner surface.

13. The closure of claim 11 wherein said first engagement portion's ratchets are located on an outer surface of said intermediate portion; and said second engagement portion's ratchets are located on said inner cap surface.

14. The closure of claim 5 wherein said intermediate portion is a ring.

15. The closure of claim 14 wherein said ring is discontinuous.

16. The closure of claim 15 wherein said ring has two chamfered ends.

17. The closure of claim 5 further comprising:

a ring tab extending from an outer surface of said intermediate portion.

18. The closure of claim 17 wherein said ring tab is curved parallel to said intermediate portion.

19. The closure of claim 5 wherein said deep end of said recess and said shallow end of said recess are connected by a continuous wall which angles from said deep end to said shallow end at a constant slope.

20. The closure of claim 5 wherein said lug includes a lug inside surface, a lug outside surface, and two lug side surfaces which intersect said lug inside and outside surfaces at right angles, and wherein said lug inside surface is a section of said neck and said lug outside surface is parallel to said lug inside surface.

21. The closure of claim 5 further comprising:

a substantially flat top surface formed on said cap; and a handle extending from said substantially flat top surface.

22. The closure of claim 21 wherein said handle further includes vertical ribs.

23. The closure of claim 5 further comprising:

a flange extending from said container between said body portion and said neck on which said intermediate portion rests.

24. The closure of claim 23 further comprising:

a intermediate portion lip extending from an outer surface of said intermediate portion and having an outer diameter the same as said flange, a cap outer surface opposite said cap inner surface, a cap lip extending from said cap outer surface having an outer diameter the same as said flange; and a flush surface formed along said outer diameters of said flange, said intermediate portion lip, and said cap lip.

25. The closure of claim 5 further comprising:

a container recess formed into said outside surface of said neck which receives said intermediate portion.

26. A method of opening a child resistant closure according to claim 5 comprising the steps of:

preventing said lug from moving into said second position; and simultaneously unscrewing said cap from said container.

27. A child resistant closure comprising:

a container having a body portion defining a chamber for holding contents, a top extending from said body portion, a hollow neck extending from said top of said body and having an inside surface and an outside surface, a container screw thread formed on said outside surface of said neck and twisting about an axis, a flange located on and extending around said outside surface of said neck about an axis concentric with said axis of said container screw thread below said container screw thread and adjacent to said top of said body portion, a container recess formed into said outside surface of said neck and positioned between said flange and said container screw thread, and a lug located on said outside surface of said neck, extending forward from said neck adjacent to said flange and having a lug inside surface and a lug outside surface, and two lug side surfaces which intersect said lug inside and outside surfaces at right angles, and wherein said lug inside surface is a section of said neck and said lug outside surface is parallel to said lug inside surface, and wherein said container is a single molded piece;

a ring positioned in said container recess and encircling said neck between said container thread and said flange about an axis that is concentric to said axis of said container screw thread, and having an inner diameter larger than said inner diameter of said flange such that said flange supports said ring, wherein said ring is discontinuous having two ends and a space between said two ends, and wherein said ring includes a ring top, a ring bottom, a ring inner surface, a ring outer surface, a ring lip extending from said ring bottom on said ring outer surface, encircling said neck and having an outer diameter equal to said outer diameter of said flange such that said ring lip is flush with said flange of said container thereby forming a flush surface, and a ring tab extending circumferentially from said ring lip beyond said flush surface formed by said ring lip and flange and upward to almost said ring top, curving parallel to said ring and having a plurality of ribs for facilitating opening;

said ring including a recess formed in said ring inner surface and aligned with said ring tab, wherein said recess is configured to include a deep end which receives said lug when the closure is closed, and a shallow end which is pushed over said lug when said ring rotates counter clockwise without said ring tab being held stationary, and whereby said space enables said ring to expand when said shallow end of said recess is pushed over said lug, a shoulder adjacent to said deep end of said recess which prevents said ring from rotating clockwise when said shoulder engages one of said lug side surfaces and said second long side of said lug, and an angled edge extending from said shallow end of said recess which allows said ring to slide over said lug when said ring is rotated counter clockwise when said cap is not on said container, wherein said recess has a wall that curves with said ring such that said wall has a thick portion extending from said ring outer surface to a position between said ring outer surface and said outer surface of said neck, and a thin portion extending from said ring outer surface to a position between said ring outer surface and said position where said thick portion terminates;

a cap including a cap inner surface extending circumferentially around said cap, a cap outer surface extending circumferentially around said cap, a cap bottom extending circumferentially around said cap, a cap top extending circumferentially around said cap opposite said cap bottom, a cap lip located on said cap outer surface at said cap bottom and extending circumferentially around said cap such that it is flush with said ring and said flange but lies between said ring tab and said ring outer surface when said cap is screwed onto said container, a cap screw thread located on said cap inner surface and twisting about an axis that is concentric with said ring and container screw thread axes, and sized to engage said container screw thread when said cap is twisted onto said container, a handle extending from said cap top and used to turn said cap, and a plurality of cap ratchets located on said cap inner surface and extending circumferentially around said cap inner surface at said cap bottom for 360 degrees, wherein said cap ratchets include semi-circle portions extending from said cap inner surface convexly with respect to said cap inner surface and spaced equally along said cap inner surface;

said ring including a plurality of ring ratchets located on said ring outer surface and extending circumferentially for approximately 125 degrees, wherein said ring ratchets have a straight radial surface which is perpendicular to said ring outer surface and a slanted side that makes acute angles with both said lug side surface and said ring outer surface, wherein said ring ratchets engage said cap ratchets lightly when said cap is turned counter clockwise but engage said cap ratchets more closely as said shallow end of said recess approaches said lug until said shallow end covers said lug causing said ring ratchets to engage said cap ratchets tightly, and thereby preventing said cap from turning counter clockwise, and wherein said ring ratchets permit said cap ratchets to slide over said ring ratchets when said ring tab is held stationary and said cap is rotated counter clockwise.

* * * * *